US005839602A

United States Patent [19]

Mowry

[11] Patent Number: 5,839,602

[45] Date of Patent: Nov. 24, 1998

[54] BUCKET SECURING DEVICE

[76] Inventor: Janet R. Mowry, R.D. 1 Box 220, Clarksburg, Pa. 15725-9705

[21] Appl. No.: 16,957

[22] Filed: Feb. 2, 1998

[51] Int. Cl.[6] ..... B65D 23/10

[52] U.S. Cl. ..... 220/737; 220/742

[58] Field of Search ..... 220/737, 738, 220/739, 740, 742, 744

[56] References Cited

U.S. PATENT DOCUMENTS

| | | | |
|---|---|---|---|
| 2,709,540 | 5/1955 | Kenney | 220/737 |
| 4,842,158 | 6/1989 | Reyes, Jr. | 220/742 |
| 4,889,376 | 12/1989 | Nagy | 220/742 |
| 4,993,611 | 2/1991 | Longo | 220/737 |
| 5,170,695 | 12/1992 | Chang | 220/737 |
| 5,730,339 | 3/1998 | Stolfo | 220/737 |

*Primary Examiner*—Joseph M. Moy

[57] ABSTRACT

The present invention relates to a device for use in securing a canister to a planar carrying surface. In its broadest context, the present invention includes a planar carrying surface. Upon an upper surface of the support a securing ring is positioned. In a preferred embodiment, this ring includes an inner surface which is coated with a rubber material to securely grip a canister. The ring further includes a latching device for using in bringing the two ends of the ring together, and thus secure a canister within the ring.

5 Claims, 2 Drawing Sheets

BUCKET SECURING DEVICE

BACKGROUND OF THE INVENTION

1. Field of the Invention

The present invention relates to a bucket holder and more particularly pertains to such a holder which allows a user to easily carry a bucket.

2. Description of the Prior Art

The use of a bucket holders is known in the prior art. More specifically, such bucket holders are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,245,807 to York discloses a bucket bracket. U.S. Pat. No. 4,045,069 to Fife discloses a paint bucket holder. U.S. Design Pat. No. 251,399 to Dark discloses the design for a wine bucket holder. U.S. Design Pat. No. 259,967 to Ramsey discloses a feed bucket holder. U.S. Pat. No. 4,776,550 to Storey discloses a paint bucket hodler for a ladder. U.S. Pat. No. 4,842,229 to Murray discloses a paint bucket holder.

In this respect, the bucket holder substantially departs from the conventional concepts and designs of the prior art, and in so doing provides an apparatus primarily developed for the purpose of enabling a user to easily transport a bucket.

Therefore, it can be appreciated that there exists a continuing need for improved bucket securing devices. In this regard, the present invention substantially fulfills this need.

SUMMARY OF THE INVENTION

In view of the foregoing disadvantages inherent in the known types of bucket holders now present in the prior art, the present invention provides an improved bucket securing device. As such, the general purpose of the present invention, which will be described subsequently in greater detail, is to secure a canister or bucket to a planar surface.

To attain this, the present invention essentially comprises a device for use in securing a canister to a planar carrying surface. In its broadest context, the present invention includes a planar carrying surface. Upon an upper surface of the support a securing ring is positioned. In a preferred embodiment, this ring includes an inner surface which is coated with a rubber material to securely grip a canister. The ring further includes a latching device for using in bringing the two ends of the ring together, and thus secure a canister within the ring.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved bucket securing device. The device includes a planar support having a first end and a second end and an intermediate extent therebetween. An oblong aperture is formed through the first end for use in carrying the support. A flexible metallic ring is included which has a first end, a second end and an intermediate extent therebetween. The first end of the ring has a pivot mount secured thereto, the second end of the ring is arcuate in shape. The ring has an interior surface and an exterior surface, with the interior surface having a layer of rubber formed thereon. A pair of securing pads are integral with the ring. The ring is secured to an upper surface of the support by way of a pair of rivets. Each of the rivets is secured through the base and one of the securing pads. A latch is provided for use in bringing together to two ends of the ring, the latch has an interconnecting band with a first end which is interconnected with the pivot mount of the first end of the ring. The interconnecting band also has a second arcuate end which is interconnected to the arcuate second end of the ring. The latch further includes a pivotal latch member which is secured proximate to the first end of the interconnecting band. This pivotal latch member has a first disengaged orientation wherein the first and second ends of the ring are spaced from one another, the latch also has a second engaged orientation wherein the interconnecting band serves to bring together the first and second ends of the ring.

It is another object of the present invention to provide a bucket securing device which enables a user to easily transport a canister.

It is a further object of the present invention to provide a latching means for use in securing a canister to a planar surface.

An even further object of the present invention is to secure a canister to a planar support by way of a flexible metallic ring such that the device of the present invention can be used with canister of various sizes.

Still yet another object of the present invention is to provide a securing device which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

The present invention relates to a device for use in securing a canister to a planar carrying surface. In its broadest context, the present invention includes a planar carrying surface. Upon an upper surface of the support a securing ring is positioned. In a preferred embodiment, this ring includes an inner surface which is coated with a rubber material to securely grip a canister. The ring further includes a latching device for using in bringing the two ends of the ring together, and thus secure a canister within the ring. The various components of the present invention, and the manner in which they interrelate, will be described in greater detail hereinafter.

Figure 1:
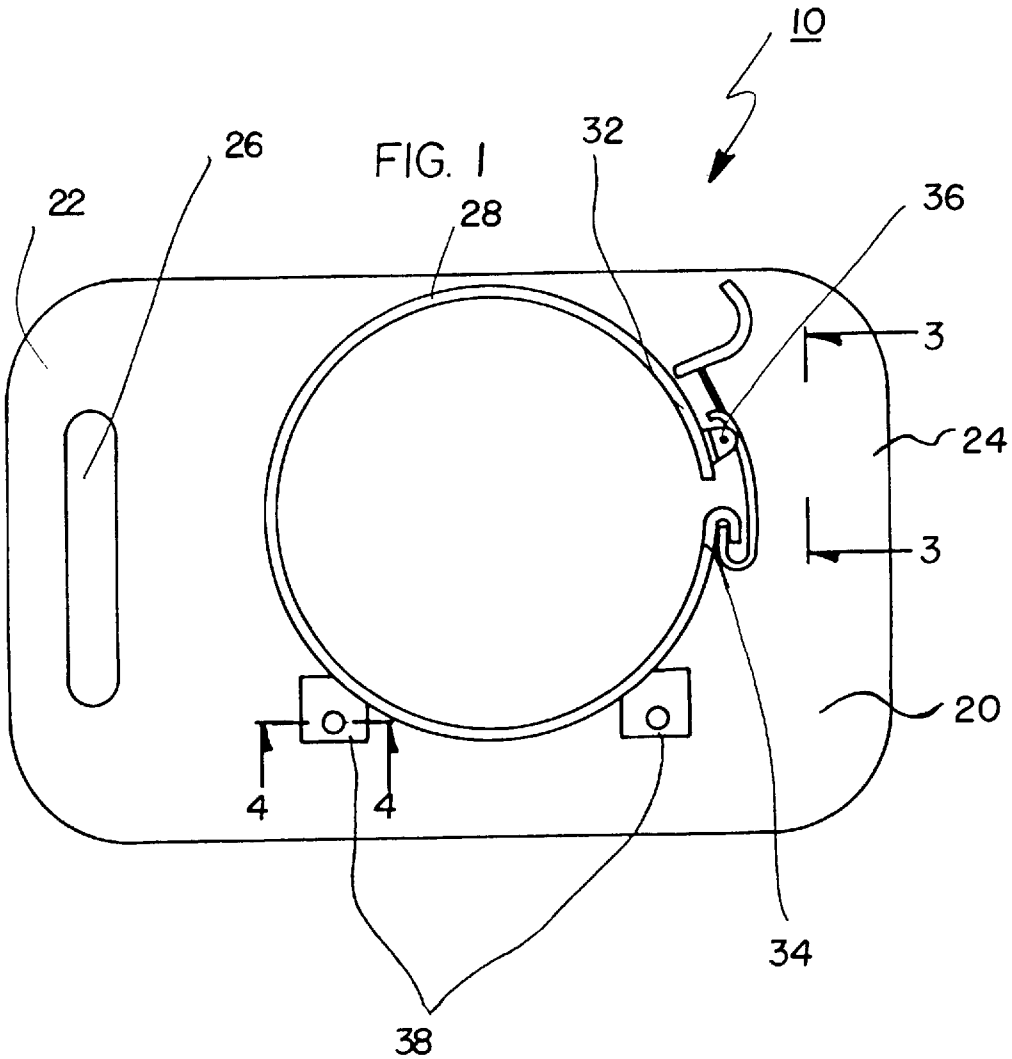
FIG. 1 is a planar view of the securing device of the present invention.
Figure 3:
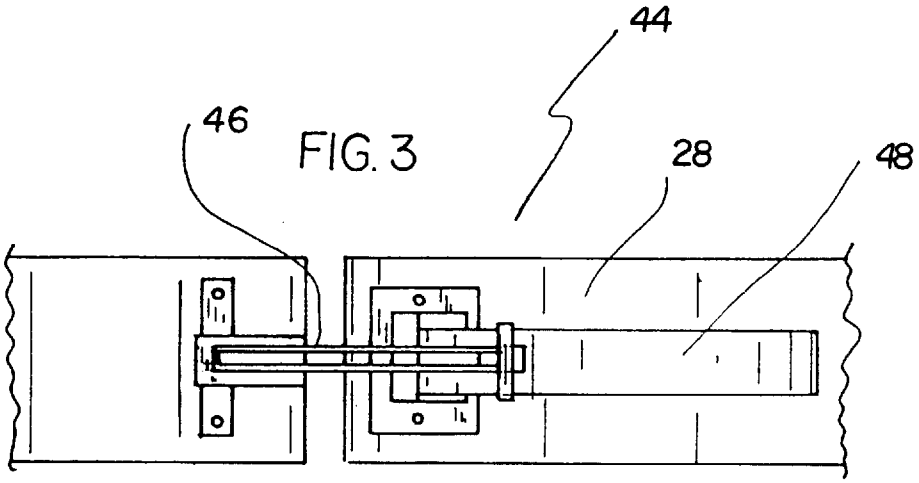
FIG. 3 is a view taken along line 3—3 of FIG. 1.

With reference to FIG. 1, the device 10 includes a planar support 20. This planar support is defined by a first end 22 and a second end 24 and an intermediate extent therebetween. Additionally, the support is further defined by upper and lower surfaces. With continuing reference to FIG. 1, an oblong aperture 26 is formed through the first end 22 of the support 20 for use in carrying the device 10. The support 20 can be formed from metal or wood.

A flexible metallic ring 28 is employed in securing a canister to the device 20. This metallic ring 28 is defined by a first end 32, a second end 34 and an intermediate extent therebetween. The first end 32 of the ring 28 includes a pivot mount 36 secured thereto, while the second end 34 of the ring 28 is arcuate in shape. The ring 28 is defined by both an interior surface and an exterior surface. In the preferred embodiment, the interior surface of the ring has a layer of rubber formed thereon. This layer of rubber material serves to enable the inner surface of the ring to be more securely gripped around the exterior surface of a canister. The ring 28 further includes a pair of securing pads 38 which are integral with the ring 28. The function of these pads 38 will be described in greater detail hereinafter.

Figure 4:
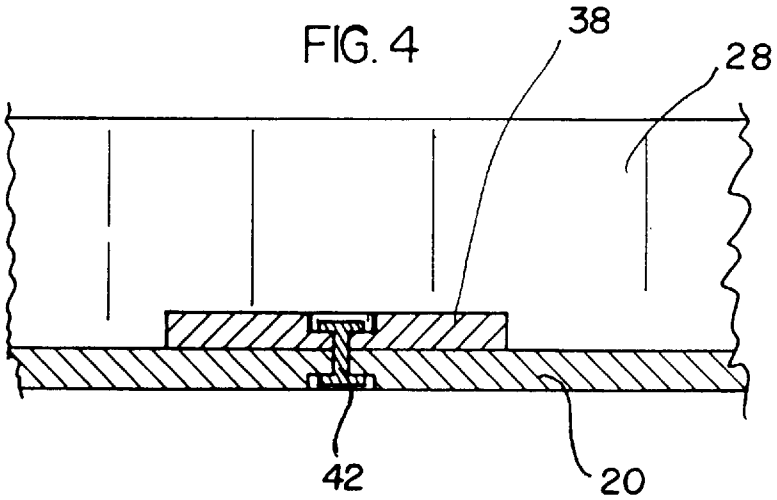
FIG. 4 is a view taken along line 4—4 of FIG. 1.

With reference to FIG. 4, the ring 28 is secured to an upper surface of the support 20 by a pair of rivets 42. Each of these rivets 42 is secured through the base 20 and one of the securing pads 38. In this manner the ring 28 is secured to an upper surface of the planar support 20.

Figure 2:
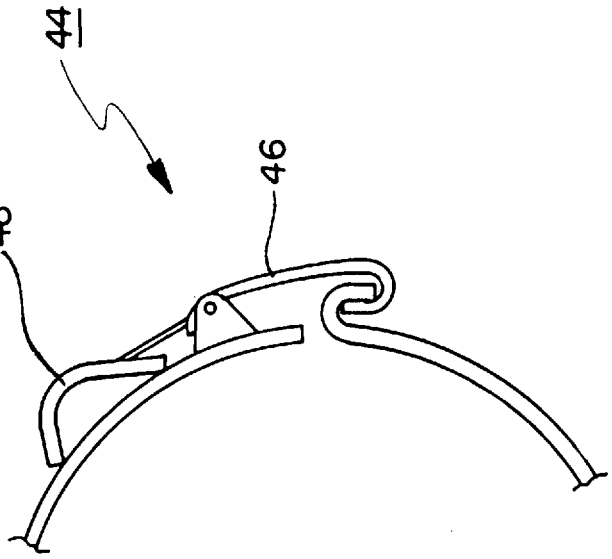
FIG. 2 is a detailed view of the latch of the present invention.

The device 10 also includes a latch 44 for use in bringing together to two ends (32 and 34) of the ring 28. The latch 42 includes an interconnecting band 46, and a pivotal latch 44. The interconnecting band 46 has a first end which is interconnected with the pivot mount 36 of the first end 32 of the ring 28. Additionally, the interconnecting band 46 also has a second arcuate end with is interconnected to the arcuate second end 34 of the ring 28. More specifically, the two arcuate ends are coupled to one another. The latch 44 further includes a pivotal latch member 48 which is secured proximate to the first end of the interconnecting band 46. This pivotal latch 48 and be pivoted upwards in a disengaged orientation, or pivoted downward in an engaged orientation. In the first disengaged orientation the first and second ends of the ring are spaced from one another, note FIG. 1. The latch 48 also having a second engaged orientation wherein the interconnecting band serves to bring together the first 32 and second ends 34 of the ring 28, note FIG. 2.

Thus, in use the pivotal latch is brought to its upward orientation and a canister is placed within the ring and upon the base. Then the pivotal latch is pivoted downward. This pivoting action serves to bring the two ends of the ring together by way of the interconnecting band. The canister is now secured to the base.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by letters patent of the United States is as follows:

1. A bucket securing device comprising in combination:

a planar support having a first end and a second end and an intermediate extent therebetween, an oblong aperture formed through the first end for use in carrying the support;

a flexible metallic ring having a first end, a second end and an intermediate extent therebetween, the first end of the ring having a pivot mount secured thereto, the second end of the ring being arcuate in shape, the ring having an interior surface and an exterior surface, the interior surface having a layer of rubber formed thereon, a pair of securing pads integral with the ring;

the ring being secured to an upper surface of the support by way of a pair of rivets, each of the rivets secured through the base and one of the securing pads;

a latch for use in bringing together to two ends of the ring, the latch having an interconnecting band with a first end which is interconnected with the pivot mount of the first end of the ring, the interconnecting band also having a second arcuate end with is interconnected to the arcuate second end of the ring, the latch further including a pivotal latch member which is secured proximate to the first end of the interconnecting band, the pivotal latch member having a first disengaged orientation wherein the first and second ends of the ring are spaced from one another, the latch also having a second engaged orientation wherein the interconnecting band serves to bring together the first and second ends of the ring.

2. A bucket securing device comprising in combination:

a planar support having a first end and a second end and an intermediate extent therebetween;

a flexible metallic ring having a first end, a second end and an intermediate extent therebetween, the first end of the ring having a pivot mount secured thereto, the second end of the ring being arcuate in shape, the ring having an interior surface and an exterior surface, the ring being secured to an upper surface of the support;

a latch for use in bringing together to two ends of the ring, the latch having an interconnecting band with a first end which is interconnected with the pivot mount of the first end of the ring, the interconnecting band also having a second arcuate end with is interconnected to the arcuate second end of the ring, the latch further including a pivotal latch member which is secured proximate to the first end of the interconnecting band, the pivotal latch member having a first disengaged orientation wherein the first and second ends of the ring are spaced from one another, the latch also having a second engaged orientation wherein the interconnecting band serves to bring together the first and second ends of the ring.

3. The bucket securing device as described in claim 2 further comprising:

an oblong aperture formed through the first end of the support for use in carrying the support.

4. The bucket securing device as described in claim 2 wherein:

the interior surface of the ring has a layer of rubber formed thereon.

5. The bucket securing device as described in claim 2 further comprising:

a pair of securing pads which are integral with the ring;

the ring being secured to an upper surface of the support by way of a pair of rivets, each of the rivets secured through the base and one of the securing pads.

* * * * *